US010639703B2

(12) United States Patent
Amador et al.

(10) Patent No.: US 10,639,703 B2
(45) Date of Patent: May 5, 2020

(54) RIVET EXTRACTOR

(71) Applicant: United Technologies Corporation, Farmington, CT (US)

(72) Inventors: Armando Amador, Wethersfield, CT (US); Maria R. Rivera-Roque, Dover, NH (US)

(73) Assignee: United Technologies Corporation, Farmington, CT (US)

( * ) Notice: Subject to any disclaimer, the term of this patent is extended or adjusted under 35 U.S.C. 154(b) by 35 days.

(21) Appl. No.: 15/983,705

(22) Filed: May 18, 2018

(65) Prior Publication Data

US 2019/0351478 A1 Nov. 21, 2019

(51) Int. Cl.
*B21J 15/50* (2006.01)

(52) U.S. Cl.
CPC ..... *B21J 15/50* (2013.01)

(58) Field of Classification Search
CPC combination set(s) only.
See application file for complete search history.

(56) References Cited

U.S. PATENT DOCUMENTS

| | | | | |
|---|---|---|---|---|
| H000419 | H * | 2/1988 | Ross | 29/275 |
| 5,370,484 | A | 12/1994 | Morikawa et al. | |
| 5,407,716 | A | 4/1995 | Mitchell | |
| 5,890,273 | A * | 4/1999 | Haytayan | B23P 19/04 225/1 |
| 7,028,380 | B2 | 4/2006 | Donovan et al. | |
| 7,043,826 | B2 * | 5/2006 | Naito | B21J 15/025 29/252 |
| 7,555,820 | B2 | 7/2009 | McEldowney et al. | |
| 2004/0025321 | A1 * | 2/2004 | Donovan | B21J 15/025 29/566 |
| 2004/0261259 | A1 * | 12/2004 | Naito | B21J 15/025 29/798 |

(Continued)

FOREIGN PATENT DOCUMENTS

| | | | |
|---|---|---|---|
| EP | 1760168 | A2 | 3/2007 |
| WO | WO02/068556 | A2 | 9/2002 |
| WO | WO2015/063525 | A1 | 5/2015 |

OTHER PUBLICATIONS

Halver V. Ross, "Contoured Punch Tool for Removing Semi-tubular Rivets," United States Statutory Invention Registration No. H419, Published Feb. 2, 1988, for U.S. Appl. No. 913,633, 6 Pages.

(Continued)

*Primary Examiner* — Bayan Salone
(74) *Attorney, Agent, or Firm* — Kinney & Lange, P.A.

(57) ABSTRACT

A tool for removing a rivet with a hole and a head from a first article that is attached to a second article includes a frame, an anvil, a push pin, and a driver. The frame includes first and second arms. The anvil includes a tube with an opening and is disposed on the first arm of the frame. The push pin is slidably engaged with the second arm of the frame and is aligned coaxially with the anvil. The push pin is configured to engage with a hole in a tail end of the rivet in order to remove the rivet from the first article. The driver is attached to the frame and is configured to move the push pin in a linear direction towards the anvil in order to push the rivet out of engagement with the first article and such that the first and second articles become unattached.

19 Claims, 8 Drawing Sheets

(56) References Cited

U.S. PATENT DOCUMENTS

| | | | |
|---|---|---|---|
| 2009/0104356 | A1 | 4/2009 | Toppen et al. |
| 2013/0004263 | A1 | 1/2013 | Palmisano |
| 2015/0151321 | A1 | 6/2015 | Brett |

OTHER PUBLICATIONS

Extended European Search Report for EP Application No. 19184256.
6, dated Oct. 14, 2019, 9 pages.

* cited by examiner

RIVET EXTRACTOR

BACKGROUND

When a rivet needs to be removed as part of the teardown process or disassembly, for example as part of an overhaul or retrofitting procedure, existing methods of rivet removal include drilling an upset end of the installed rivet and then using a punch to drive it out. Such procedures create a high potential for debris (e.g., foreign object debris ("FOD")) as a result of the drilling to enter into the surrounding environment or assemblies of which the rivet is (or was) a part. Such debris can cause contamination of critical components like bearings and seals as well as causing damage sustained during the drilling or punch process to adjacent parts. Such a process can also vary from mechanic to mechanic, resulting in inconsistent removal efficiency and varying levels of debris creation causing contamination to surrounding assemblies.

SUMMARY

A tool for removing a rivet that connects a first article and a second article includes a frame, an anvil, a push pin, and a driver. The frame includes first and second arms. The anvil includes a tube with an opening with an inner diameter and is disposed on the first arm of the frame. The push pin is slidably engaged with the second arm of the frame and is aligned coaxially with the anvil. The push pin is configured to engage with a hole in a tail end of the rivet in order to remove the rivet from the first article. The driver is attached to the frame and is configured to move the push pin in a linear direction towards the anvil in order to push the rivet out of engagement with the first article and such that the first and second articles become unattached.

A method of removing a rivet from first and second articles includes aligning a rivet removal tool with the rivet. The rivet removal tool includes an anvil with a tube and push pin. The rivet includes a head and a hole disposed on an opposite end of the rivet from a head of the rivet. The push pin is configured to move linearly relative to the anvil. Aligning the rivet removal tool with the rivet includes aligning the push pin with a hole in the rivet. The anvil is brought into contact with the first article. The push pin is moved in a linear direction and towards the anvil. The push pin is inserted into the hole of the rivet. The push pin is brought into contact with the rivet. The rivet is pushed with the push pin such that the rivet moves relative to the first article. The rivet is then separated from the first article.

DETAILED DESCRIPTION

The disclosure described herein describes a removal tool and method of rivet extraction. The disclosure discusses a rivet removal tool with push pin and anvil features used to force a rivet off of an article by deforming previously upset material of the rivet. In particular, a push pin applies force to the tail end of the rivet in order to push the rivet out of engagement with an article by causing the upset tail end of the rivet to collapse, become dislodged from the article, and remove from the article in a head-first direction. The anvil braces a first side of the article while the push pin is driven into a hole of the rivet from the tail end of the rivet. As will be discussed, the push pin and anvil features can be part of a plier like tool (driven either manually or hydraulically).

Figure 1A:
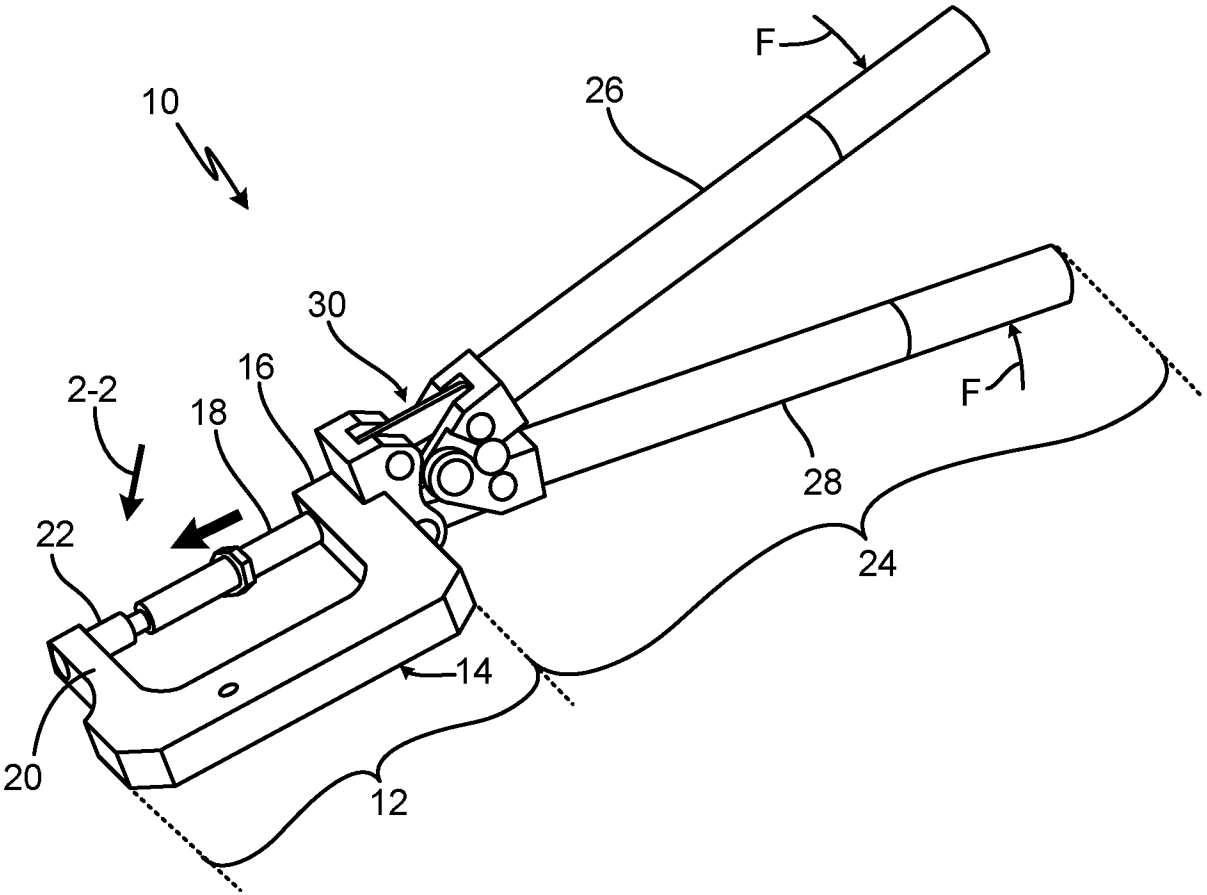
FIG. 1A is a perspective view of a rivet removal tool with a rivet extractor in a first, engaged position.

FIG. 1A is a perspective view of rivet removal tool 10 and shows rivet extractor 12 (which includes frame 14, first arm 16, push pin 18, and second arm 20 (with anvil 22)), and push pin driver 24 (which includes first handle 26, second handle 28, and driver 30).

Rivet removal tool 10 is an assembly of components arranged in such a way so as to enable removal of a rivet from an article. Rivet extractor 12 is the part of rivet removal tool 10 that engages push pin 18 and anvil 22 with the rivet in order to remove the rivet that connects two (or more) components by pushing the rivet with push pin 18 head-first out of engagement with the two (or more) components. Frame 14 is a C-shaped piece of solid material and includes first arm 16 and second arm 20 that are attached to a center portion of frame 14. First arm 16 and second arm 20 are elongated extensions of solid material located at opposite ends of C-shaped frame 14. First arm 16 includes a guide at a distal end of first arm 16 (i.e., a hole or bore) through which push pin 18 extends. Push pin 18 is an elongated piece of solid material. In this non-limiting embodiment, push pin 18 includes a generally cylindrical shape with a stepped configuration that reduces in diameter towards a distal end of push pin 18 from first arm 16. Second arm 20 is a jaw of frame 14 and includes anvil 22. Anvil 22 is a hollow tube of solid material that is located at a distal end of second arm 20. In other non-limiting embodiment, anvil 22 can include a plurality of rods, a cage, or otherwise include one or more openings or spatial interruptions in the tube.

Push pin driver 24 is an assembly including first handle 26, second handle 28, and driver 30. In this non-limiting embodiment, push pin driver 24 includes two first-class levers (e.g., first and second handles 26 and 28) joined at a fulcrum (e.g., driver 30). First handle 26 and second handle 28 are elongated pieces of solid material. In this non-limiting embodiment, first handle 26 and second handle 28 are levers. In other non-limiting embodiment, first handle 26 and/or second handle 28 can include various configurations to improve a lever advantage and/or ergonomics. Driver 30 is a portion of rivet removal tool 10 that includes a pivot or fulcrum. Force F is a force applied to at least one of first and second handles 26 and 28.

In this non-limiting embodiment, all of the components of rivet removal tool 10 are interconnected. In this non-limiting embodiment, rivet extractor 12 is dynamically connected to driver 30. In other non-limiting embodiments, rivet extractor 12 may not be connected to a lever portion via a fulcrum portion. First arm 16 of frame 14 is mounted to a portion of driver 30. First arm 16 and second arm 20 are connected to and extend from opposite ends of a center portion of frame 14. In this non-limiting embodiment, first arm 16 and second arm 20 are parallel. Push pin 18 is dynamically connected and slidably engaged with first arm 16 of frame 14. Anvil 22 is connected to and extends from a portion of second arm 20. First handle 26 and second handle 28 of push pin driver 24 are dynamically connected to driver 30. First handle 26 and second handle 28 are mounted to portions of driver 30. Driver 30 connects to first and second handles 26 and 28 and to rivet extractor 12.

Rivet removal tool 10 functions to remove a rivet from an assembly. Rivet removal tool 10 is configured to convert force F applied to push pin driver 24 into a force that is applied to push pin 18 in order to move push pin 18 in a linear direction relative to anvil 22 (i.e., pushing the rivet towards anvil 22).

Rivet extractor 12 operates to remove an installed rivet by pushing the rivet out of its installed state with push pin 18 and anvil 22. Frame 14 supports first arm 16 and second arm 20 of rivet extractor 12. First arm 16 houses an end of push pin 18 and is slidably engaged with push pin 18 such that push pin 18 moves linearly relative to first arm 16 and to second arm 20. Push pin 18 extends through a portion of first arm 16 and is slidably engaged with first arm 16. Push pin 18 is also dynamically connected to driver 30 such that push pin 18 moves in a linear direction in response to a force (i.e., in the form of force F) applied to first handle 26 and/or second handle 28. Second arm 20 supports anvil 22 such that as driver 30 transfers force to push pin 18, push pin 18 can move in a linear direction relative to anvil 22. Anvil 22 functions by supporting an article (not shown in FIG. 1A) such that push pin 18 can move relative to (e.g., away from or toward) the supported article as force F is applied to first handle 26 and/or second handle 28 of rivet removal tool 10. Anvil 22 functions as a support and a receptacle for a removed rivet.

First handle 26 and second handle 28 of push pin driver 24 receives a force or forces in the form of force F applied to at least one of first and second handles 26 and 28 and transfers that force or forces to driver 30. Driver 30 is connected to push pin 18 and is configured to apply a mechanical advantage in order to cause anvil 22 to move relative to push pin 18. First handle 26 and second handle 28 directly or indirectly receive force in the form of force F. In some non-limiting embodiments, force can be applied to any one of first handle 26, second handle 28, driver 30, or to rivet extractor 12 in order to cause relative motion between push pin 18 and anvil 22 of second arm 20. In this non-limiting embodiment, movement of push pin 18 relative to anvil 22 is configured to be driven by manual operation of a user such as a mechanic. In other non-limiting embodiment, movement of push pin 18 relative to anvil 22 can be configured to be driven by at least one of pneumatic and hydraulic operation.

Driver 30 translates or converts force F applied to first handle 26 and/or second handle 28 into relative linear motion between push pin 18 and second leg 20 with anvil 22. Put another way, driver 30 converts force F applied to first handle 26 and second handle 28 of rivet removal tool 10 into a force that is applied to push pin 18 in order to move push pin 18 in a linear direction relative to (i.e., toward or away from) anvil 22 of second arm 20. As applied to at least one of first and second handles 26 and 28, force F causes rotation of at least one of first and second handles 26 and 28 about driver 30.

Rivet removal tool 10 with rivet extractor 12 allows for a compact design, an integrated function component, ability to remove a rivet without drilling/prying/punching, prevention of FOD formation, an easy to use design, less damage to hardware, and allows for manual or hydraulic operation. The use of rivet removal tool 10 with rivet extractor 12 to remove a rivet reduces or eliminates creation of FOD as a result of the non-creation of swarf, turnings, filings, or shavings resulting from drilling out the rivet. This elimination or prevention of the creation of FOD reduces contamination of critical components like bearings and seals as well as preventing damage sustained during a drilling or punch process to adjacent parts. The use of rivet removal tool 10 with rivet extractor 12 also allows for a consistent, standardized, and easily repeatable rivet removal process allowing different users (i.e., mechanics) to execute consistent removal efficiency and elimination of FOD.

Figure 1B:
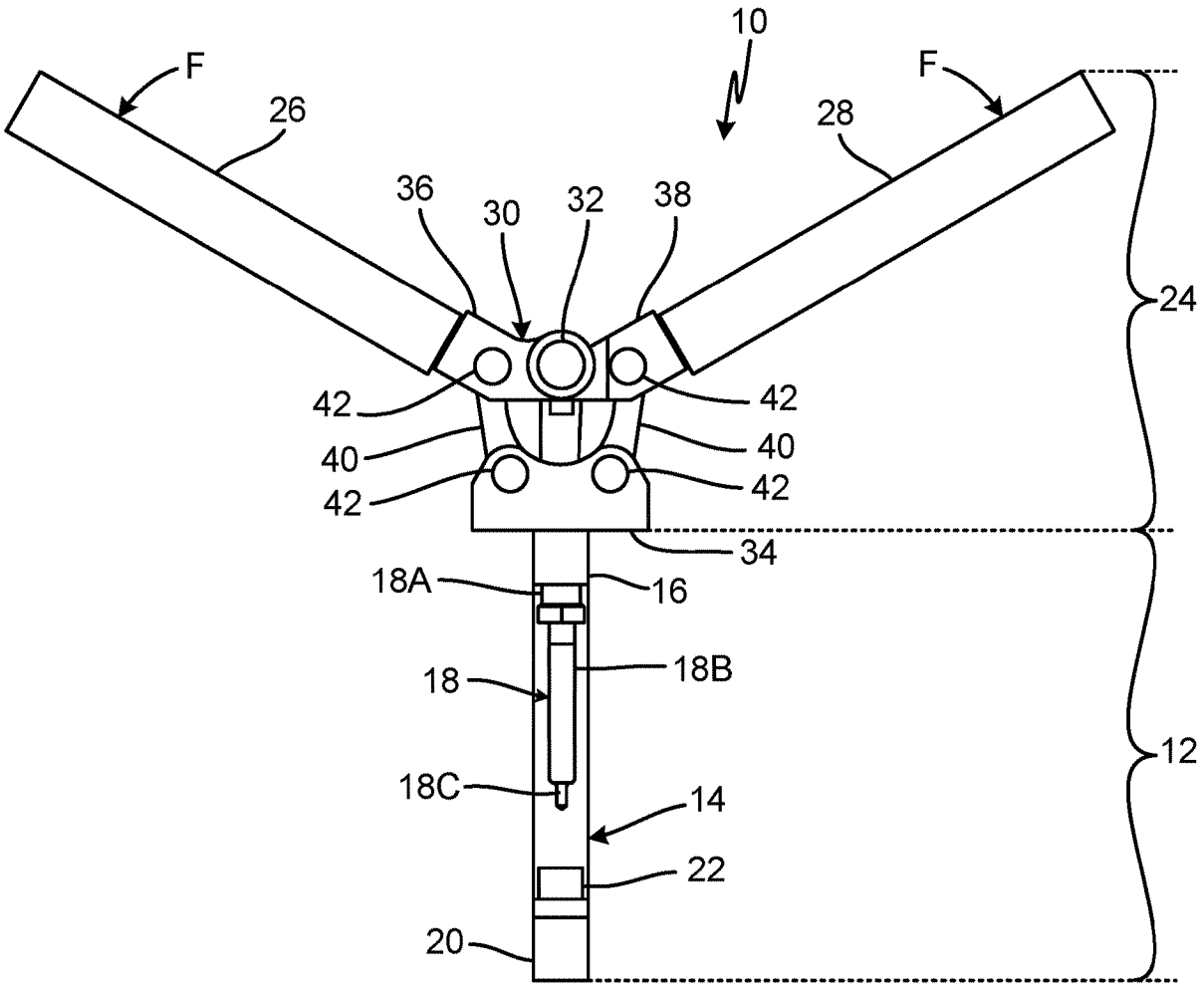
FIG. 1B is a side view of the rivet removal tool with the rivet extractor in a second, withdrawn position and shows a push pin and a pivot.

FIG. 1B is a side view of rivet removal tool 10 with rivet extractor 12 in a second position and shows push pin 18 and pivot 32. FIG. 1B shows rivet extractor 12 (with frame 14, first arm 16, push pin 18 (including shaft 18A, neck 18B, and tip 18C), and second arm 20 (including anvil 22)), push pin driver 24 (with first handle 26 and second handle 28), driver 30, pivot 32, double clevis 34, first single clevis 36, second single clevis 38, links 40, and push pins 42. Similarly, the description of push pin 18 provided above with respect to FIG. 1A also applies to push pin 18 shown in FIG. 1B (and to push pin 18 shown in FIG. 1C).

Shaft 18A is an elongated rod of solid material. Neck 18B is a rod of solid material that has a diameter that is smaller than a diameter of shaft 18A. Tip 18C is a rod of solid material that has a diameter that is smaller than a diameter of neck 18B. In this non-limiting embodiment, shaft 18A and neck 18B telescope to allow a total length of push pin 18 to be adjusted. In another non-limiting embodiment, neck 18B can be threaded into shaft 18A and locked or set together with a nut. In this non-limiting embodiment, driver 30 is a five pivot push pin and clevis assembly. Pivot 32 is a rod of solid material. In this non-limiting embodiment, rivet removal tool 10 with rivet extractor 12 is shown in an open position such that first and second handles 26 and 28 are withdrawn from each other and push pin 18 is drawn away from anvil 22. For example, see FIG. 1A which depicts a closed position of rivet removal tool 10 with rivet extractor 12 that shows first and second handles 26 and 28 drawn towards each other and push pin 18 driven towards anvil 22.

Double clevis 34 is a connector including two U-shaped or forked connectors of solid material. First single clevis 36 and second single clevis 38 are U-shaped or forked connectors of solid material. Links 40 are connectors or couplings of solid material. Push pins 42 are cylinders of solid material. Push pin 18 is attached to pivot 32 at an end of push pin 18. In this non-limiting embodiment, push pin 18 is rotatably attached to pivot 32. Neck 18B is configured to insert into an inner diameter of anvil 22. Tip 18C is configured to insert into a depression of the rivet that is being removed. Pivot 32 is disposed in a portion of driver 30 and is attached to ends of first and second handles 26 and 28.

Double clevis 34 is mounted to a portion of first arm 16 of frame 14 and is dynamically connected to links 40 with push pins 42. First single clevis 36 is mounted onto an end of first handle 26 and is attached to one of links 40 via one of push pins 42. Second single clevis 38 is mounted onto an end of second handle 28 and is attached to one of links 40 via one of push pins 42. Links 40 extend between and are connected to double clevis 34, first single clevis 36, and second single clevis 38. Each of links 40 are rotatably connected to push pins 42. Push pins 42 extend through openings in double clevis 34, first single clevis 36, second single clevis 38, and links 40 so as to dynamically connect links 40 to double clevis 34, first single clevis 36, and second single clevis 38.

In this non-limiting embodiment, as first and second handles 26 and 28 are driven or pulled apart with force F, pivot 32 is drawn away from frame 14 as shown in FIG. 1B. By way of its connection to pivot 32, as pivot 32 is drawn away from frame 14, push pin 18 translates linearly relative to first arm 16 and away from anvil 22 on second arm 20. As can be seen with the connection between push pin 18 and pivot 32, push pin 18 is drawn along with pivot 34 by way of the direct mechanical connection between push pin 18 and pivot 32.

Conversely, as first and second handles 26 and 28 are driven together with force F applied to first and second handles 26 and 28 (see e.g., FIG. 1A), pivot 32 is driven towards first arm 16 of frame 14. By way of its connection to pivot 32, as pivot 32 is driven towards frame 14, push pin 18 translates linearly relative to first arm 16 and towards anvil 22 on second arm 20. As can be seen with the connection between push pin 18 and pivot 32, push pin 18 is driven by pivot 34 by way of the direct mechanical connection between push pin 18 and pivot 32.

As will be discussed with respect to the remaining figures, the linear translation of push pin 18 towards or away from anvil 22 allows rivet extractor 12 to engage with a rivet mounted in an article in such a way as to remove the rivet from the article without the need of drilling, prying, or punching which can create FOD detrimental to operation of the article.

Figure 1C:
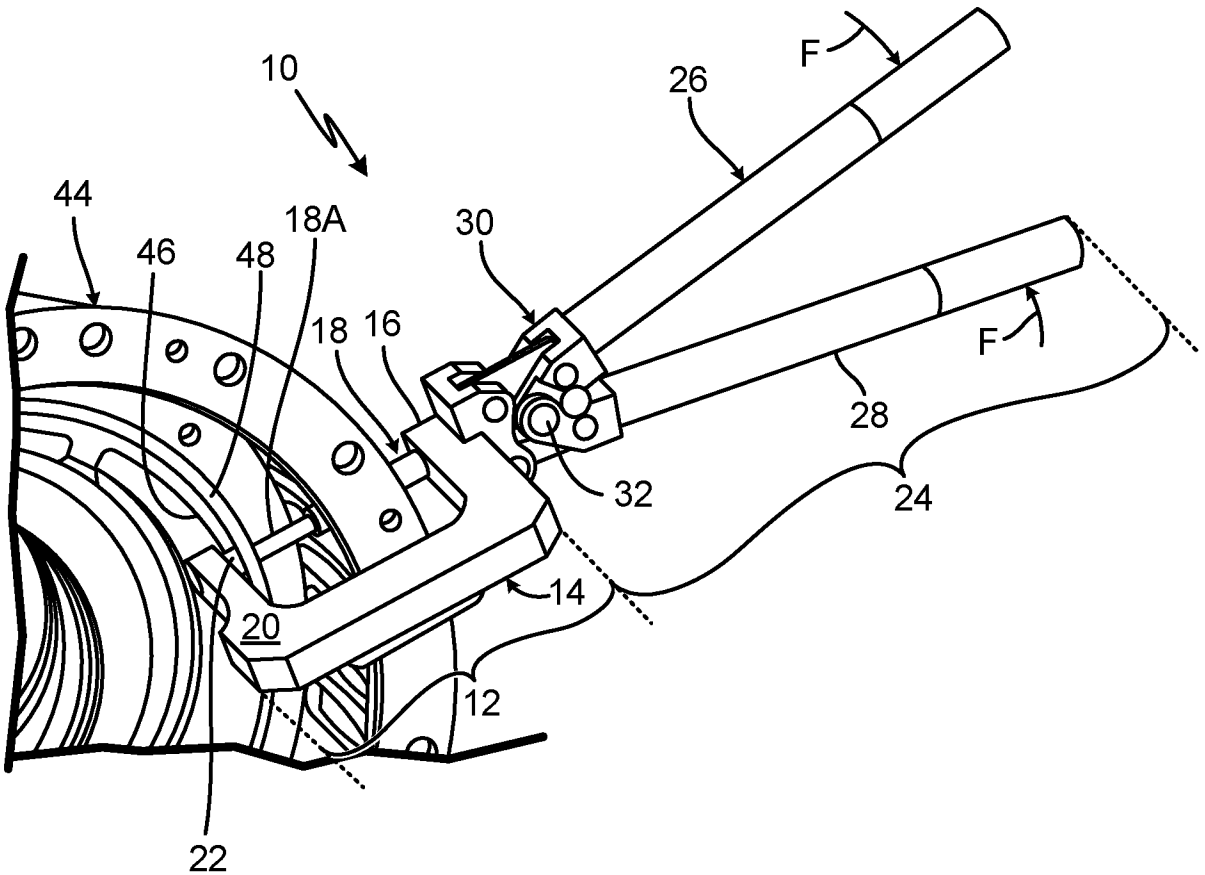
FIG. 1C is a perspective view of the rivet removal tool engaged with elements from a bearing compartment of an aircraft.

FIG. 1C is a perspective view of rivet removal tool 10 engaged with bearing assembly 44 from a bearing compartment of an aircraft (not shown). FIG. 1C shows rivet extractor 12 (with frame 14, first arm 16, push pin 18, and second arm 20 (including anvil 22)), push pin driver 24 (with first handle 26 and second handle 28), driver 30, pivot 32, and bearing assembly 44 (with seal carrier 46 and retaining ring 48). In FIG. 1C, bearing assembly 44 with seal carrier 46 and retaining ring 48 is shown in a partial perspective view.

In this non-limiting embodiment, seal carrier 46 and retaining ring 48 include adjacent bearing articles of a bearing compartment of an aircraft. In this non-limiting embodiment, seal carrier 46 and retaining ring 48 are in contact with each other and are affixed to one another via a rivet (not shown in FIG. 1C) or rivets. In this non-limiting embodiment, a rivet is located along portions of seal carrier 46 and retaining ring 48 such that the rivet is aligned with both push pin 18 and anvil 22. For example, each of push pin 18, anvil 22, and the rivet are generally aligned coaxially and/or collinearly with each other (see e.g., FIGS. 4A-5B).

Rivet extractor 12 is positioned relative to bearing assembly 44 such that push pin 18 is disposed adjacent to a portion of retaining ring 48 and anvil 22 is disposed adjacent to a portion of seal carrier 46. Rivet extractor 12 is also positioned relative to bearing assembly 44 such that push pin 18 is in coaxial and/or collinear alignment with the rivet that is used to attached seal carrier 46 and retaining ring 48 together, such that anvil 22 and the rivet are in axial alignment with a centerline axis of push pin 18. In other words, anvil 22 and push pin 18 are in axial alignment with an axial centerline of the rivet.

Anvil 22 acts as a support that presses against seal carrier 46. As push pin 18 is caused to move towards anvil 22 by push pin driver 24, anvil 22 braces against seal carrier 46 to hold seal carrier 46 (and retaining ring 48) still as push pin 18 translates linearly towards anvil 22. After push pin 18 comes into contact with the rivet, push pin 18 drives the rivet out of retaining ring 48 and seal carrier 46 and into anvil 22.

Figure 2:
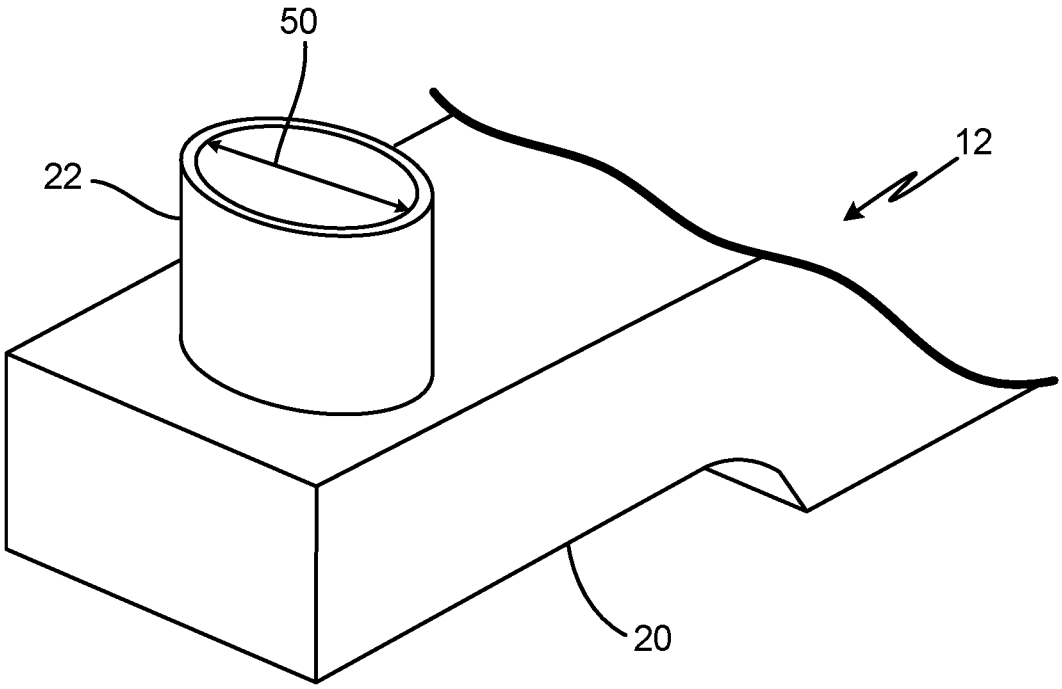
FIG. 2 is a perspective view taken from 2-2 in FIG. 1A of a portion of the rivet extractor that includes a jaw and an anvil.

FIG. 2 a perspective view taken from 2-2 in FIG. 1A of a portion of rivet extractor 12 and shows second arm 20 with anvil 22 (including opening 50). In this non-limiting embodiment, anvil 22 comprises a solid tube with a circumferentially continuous sidewall. In other non-limiting embodiments, anvil 22 can comprise a series of columns, a mesh formation, or a cage with a series of openings in the sidewall. Opening 50 is an interior opening or passage of support 20 (that is a tube). In this non-limiting embodiment, opening 50 includes a circular shape. In other non-limiting embodiments, opening 50 can include other cross-section shapes such as an ellipse or rectangle.

Anvil 22 is attached and/or mounted to second arm 20. Anvil 22 can be welded, press-fit, or otherwise mechanically affixed to second arm 20. In another non-limiting embodiment, anvil 22 can be attached and/or mounted to frame 14. Opening 50 extends through a length of anvil 22. In another non-limiting embodiment, opening 50 can extend into a portion of second arm 20. In yet another non-limiting embodiment, opening 50 can extend completely through second arm 20 such that opening 50 forms a passage extending through both of anvil 22 and second arm 20.

In this non-limiting embodiment, second arm 20 remains fixed with respect to frame 14. Also in this non-limiting embodiment, push pin 18 is moveable relative to frame 14, second arm 20, and anvil 22. Opening 50 of anvil 22 functions to receive a rivet as rivet extractor 12 pushes the rivet out of an article (or articles), such as seal carrier 46 and retaining ring 48 shown in FIG. 1C. Opening 50 contains the removed rivet by providing a cavity for the rivet to fall into and become captured. A sidewall of anvil 22 that defines opening 50 creates a physical barrier that contains the rivet. As will be discussed with reference to FIG. 4A, opening 50 is large enough to accommodate a size of a head of the rivet such that the rivet can pass through opening 50. In combination with push pin 18 (shown in FIGS. 1A-1C), anvil 22 with opening 50 allows a rivet to be removed from an article and contained within anvil 22. Anvil 22 with opening 50 contains the rivet and possible debris from a breakage of the upset material and prevents such debris (e.g., FOD) from infiltrating/permeating into areas of bearing assembly 44 (shown in FIG. 1C).

Figure 3:
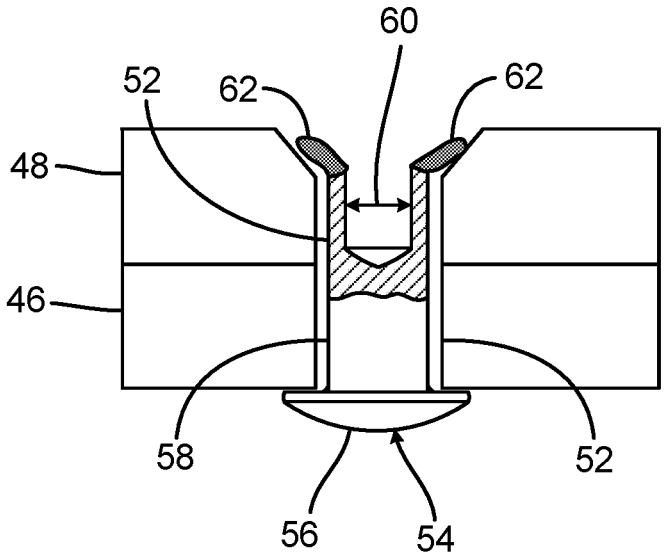
FIG. 3 is a side view of a retaining ring and a seal carrier fastened by a rivet, with the rivet shown in a partial cross-section view.

FIG. 3 is a side view of seal carrier 46 and retaining ring 48 that are fastened together by rivet 54, with rivet 54 shown in partial cross-section. FIG. 3 shows push pin 18, anvil 22, seal carrier 46 and retaining ring 48 (with passage 52), and rivet 54 (with head 56, shaft 58, hole 60, and tail 62).

Rivet 54 is a mechanical fastening device that includes head 56, shaft 58, hole 60, and tail 62. In this non-limiting embodiment, rivet 54 is a semi-tubular rivet. In other non-limiting embodiments, rivet 54 can include a fully tubular rivet, a semi-tubular step rivet, or a special tubular rivet. Passage 52 is a passageway extending through both of seal carrier 46 and retaining ring 48. Head 56 is a portion of rivet 54 that includes a larger outer diameter than the other portions of rivet 54 (such as shaft 58). Head 56 is also known as the factory-head portion of rivet 54. Shaft 58 is a cylinder of solid material. In this non-limiting embodiment, a portion of shaft 58 includes hole 60. Hole 60 is a hollow cavity or indentation. Tail 62, or upset material, is a portion of solid material that is formed together with and extends from shaft 58. Tail 62 is also known as the shop-head portion of rivet 54. Tail 62 is material formed during the installation of rivet 54 into seal carrier 46 and retaining ring 48. During installation of rivet 54, shaft 58 is deformed to create tail 62. For example, tail 62 is upset or bucked (deformed) so that tail 62 expands.

Rivet 54 is disposed in passage 52 of seal carrier 46 and retaining ring 48. In this view shown in FIG. 3, rivet 54 is affixed to seal carrier 46 and retaining ring 48. In other non-limiting embodiments, rivet 54 can be affixed to more than two components. Passage 52 extends through a portion of seal carrier 46 and through a portion of retaining ring 48. Head 56 is disposed on an end of rivet 54 and is connected to shaft 58. Shaft 58 is connected to head 56 of rivet 54. Hole 60 extends into a portion of shaft 58 from an end of shaft 58 opposite from head 56. Tail 62 is connected to and extends from shaft 58. Tail 62 is in contact with retaining ring 48.

Rivet 54 prevents rotation with and fastens seal carrier 46 to retaining ring 48. Rivet 54 functions to withstand shear and tensile loads placed on rivet 54 by relative motion between seal carrier 46 and retaining ring 48. Passage 52 provides a cavity within which rivet 54 can extend through both seal carrier 46 and retaining ring 48. Head 56 presses against a portion of seal carrier 46 so as to brace seal carrier 46 against retaining ring 48. Head 56 and tail 62 function together to affix/fasten seal carrier 46 and retaining ring 48 together in a (semi-) permanent manner. Shaft 58 physically connects head 56 to tail 62.

Hole 60 provides a receiving port for an installation tool. During installation of rivet 54, hole 60 provides a locating feature in rivet 54 that acts to partially contain an installation push pin. During installation, the installation push pin presses into hole 60 and deforms a portion of shaft 58 thereby creating tail 62. Tail 62 extends radially outward from shaft 58 and presses against portions of retaining ring 48 to press retaining ring 48 against seal carrier 46. As shown in this non-limiting embodiment, tail 62 extends radially outward past a diameter of passage 52 so as to prevent rivet 54 from moving in passage 52.

Existing methods of removing rivets from articles (such as rivet 54 from seal carrier 46 and retaining ring 48) often include drilling/prying/punching the rivet in order to dislodge the rivet from the passage. These methods however, often produce undesirable FOD (e.g., swarf) that can cause contamination of and damage to critical components and adjacent parts in the context of machinery (e.g., a turbine engine).

Figure 4B:
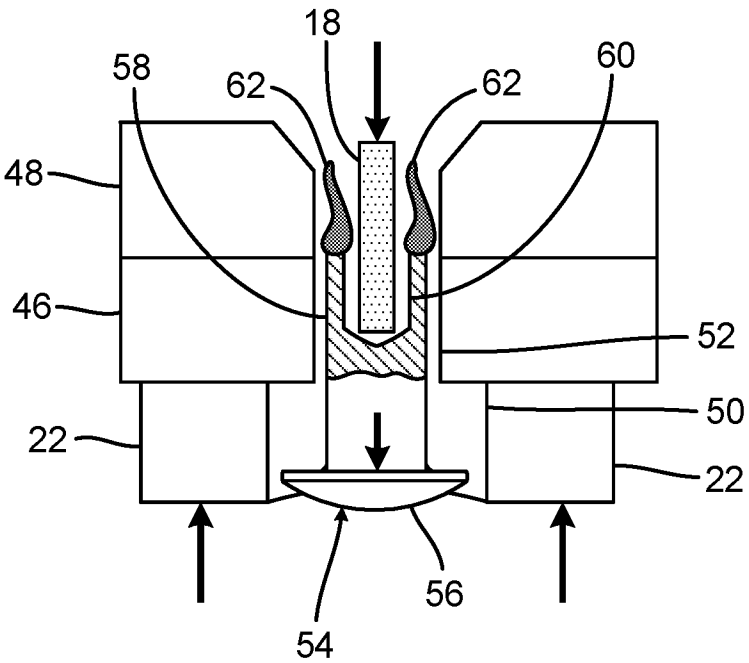
FIG. 4B is a side view of the rivet extractor engaged with the first and second articles and with the rivet such that the rivet extractor occupies a second position.
Figure 4A:
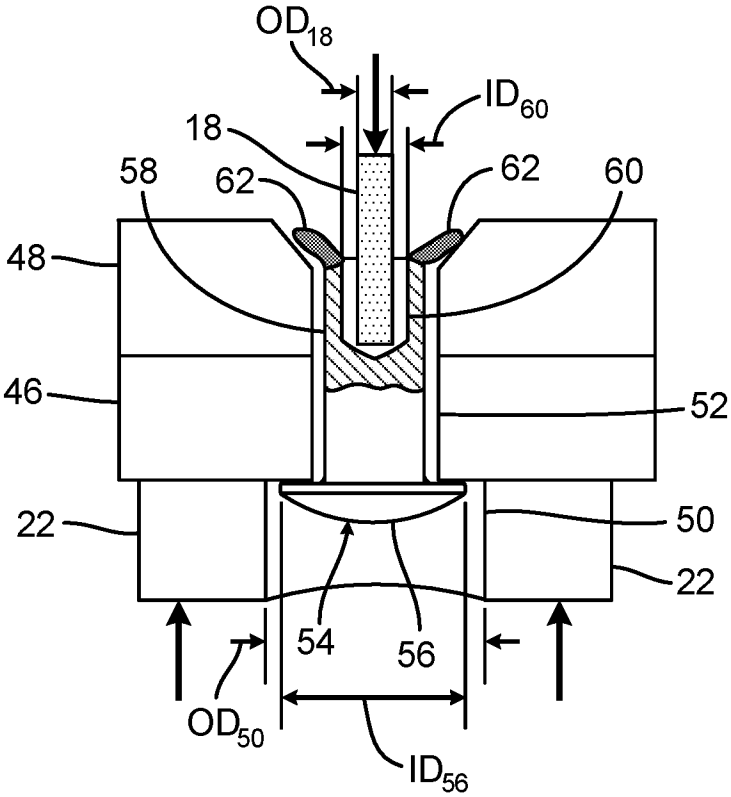
FIG. 4A is a side view of the rivet extractor engaged with the first and second articles and with the rivet such that the rivet extractor occupies a first position.

FIG. 4A is a side view of push pin 18 and anvil 22 engaged with seal carrier 46 and retaining ring 48 and with rivet 54 such that push pin 18 and anvil 22 occupy a first, fastened position. FIG. 4A shows push pin 18, anvil 22 (with opening 50), seal carrier 46 and retaining ring 48 (with passage 52), and rivet 54 (with head 56, shaft 58, hole 60, and tail 62). FIG. 4A also shows outer diameter $OD_{18}$ of push pin 18, inner diameter $ID_{50}$ of opening 50, outer diameter $OD_{56}$ of head 56, and inner diameter $ID_{60}$ of hole 60.

Outer diameter $OD_{18}$ is a diameter of an outer radial edge of push pin 18. Inner diameter $ID_{50}$ is a diameter of a portion of anvil 22 that defines opening 50. Outer diameter $OD_{56}$ is a diameter of an outer radial edge of head 56. Inner diameter $ID_{60}$ is a diameter of hole 60. In this non-limiting embodiment, outer diameter $OD_{18}$ of push pin 18 is less than inner diameter $ID_{60}$ of hole 60. Also in this non-limiting embodiment, inner diameter $ID_{50}$ of opening 50 is greater than outer diameter $OD_{56}$ of head 56. With inner diameter $ID_{50}$ of opening 50 being greater than outer diameter $OD_{56}$ of head 56, there is enough clearance between head 56 and anvil 22 to allow head 56 of rivet 54 to pass through opening 50. In this non-limiting embodiment, push pin 18 of rivet removal assembly 12 is aligned with hole 60 of rivet 54. Additionally, push pin 18, rivet 54, and (opening 50 of) anvil 22 are coaxially and collinearly aligned with each other.

Anvil 22 is brought into contact with seal carrier 46. As can be seen in FIGS. 4A and 4B, anvil 22 comes into contact with seal carrier 46 such that opening 50 is aligned coaxially with passage 52 and with rivet 54. Anvil 22 is also positioned such that head 56 of rivet 54 is inserted into a portion of opening 50. Push pin 18 is moved in a linear direction and towards anvil 22 such that push pin 18 is inserted into hole 60 and is brought into contact with rivet 54. Anvil 22 braces against seal carrier 46 to counter-balance the load imparted by push pin 18. As will be seen in FIG. 4B, after push pin 18 is inserted into hole 60 and brought into contact with rivet 54, rivet 54 can be pushed out of passage 52 of seal carrier 46 and retaining ring 48 without the need to drill/pry/punch rivet 54.

FIG. 4B is a side view of push pin 18 and anvil 22 engaged with seal carrier 46 and retaining ring 48 and with rivet 54 such that push pin 18 and anvil 22 occupy a second, unfastened position. FIG. 4B shows push pin 18, anvil 22 (with opening 50), seal carrier 46 and retaining ring 48 (with passage 52), and rivet 54 (with head 56, shaft 58, hole 60, and tail 62).

As shown in FIG. 4B, as rivet 54 is pushed down into passage 52 (e.g., downward as shown in FIGS. 4A and 4B), tail 62 of rivet 54 is effectively pushed radially inward by portions of passage 52 thereby bending tail 62 radially inward until an outer diameter of tail 62 becomes less than an inner diameter of passage 52. Once the outer diameter of tail 62 becomes less than the inner diameter of passage 52, rivet 54 can then pass through passage 52 with its linear translation through passage 52 unimpeded by tail 62. In other words, tail 62 is deformed such that rivet 54 disengages from retaining ring 48. As rivet 54 disengages from retaining ring 48, rivet 54 goes from a fastened state with retaining ring 48 (and seal carrier 46) to an un-fastened state with retaining ring 48 (and seal carrier 46).

As shown in FIG. 4B, rivet 54 is pushed with push pin 18 such that rivet 54 moves relative to anvil 22, seal carrier 46, and retaining ring 48. Head 56 of rivet 54 comes out of contact with seal carrier 46 as rivet 54 moves through and out of passage 52. Rivet 54 is then translated in a downward direction, out of passage 52, and is separated from seal carrier 46 (see e.g., FIG. 5B).

Figure 5B:
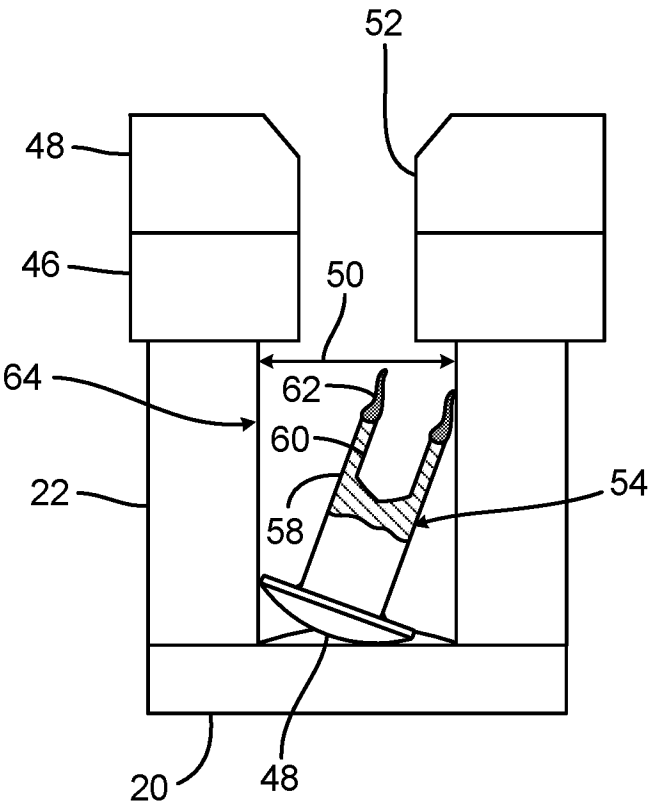
FIG. 5B is a side view of the first and second articles with the rivet shown as captured in the cavity of the anvil of the second rivet extractor.
Figure 5A:
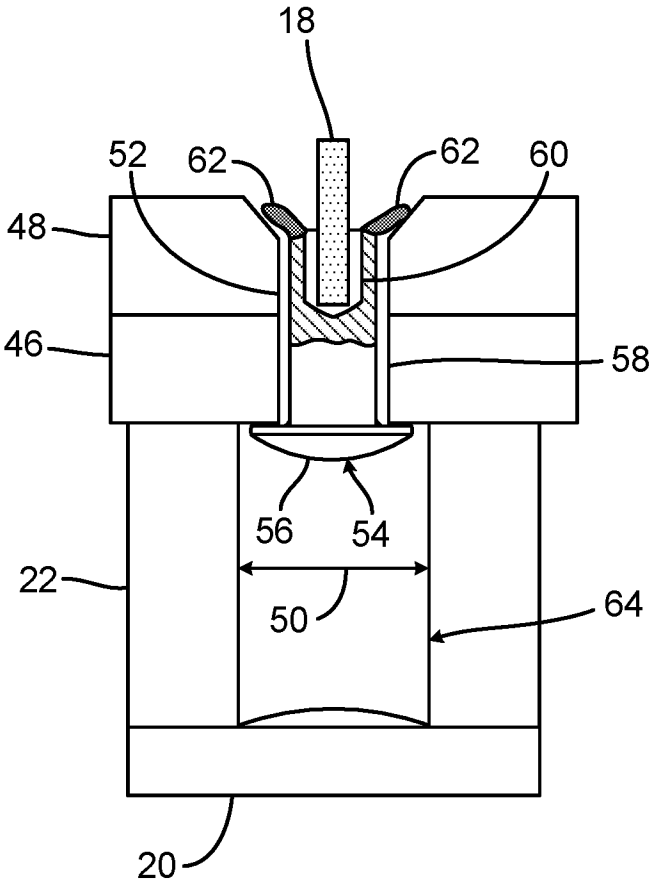
FIG. 5A is a side view of a second rivet extractor engaged with the first and second articles, with the second rivet extractor including a cavity.

FIG. 5A is a side view of push pin 18 and anvil 22 engaged with seal carrier 46 and retaining ring 48, with anvil 22 including cavity 56. FIG. 5A shows push pin 18, second arm 20, anvil 22 (with opening 50 and cavity 56), seal carrier 46 and retaining ring 48 (with passage 52), and rivet 54 (with head 56, shaft 58, hole 60, and tail 62) in a first, fastened state.

In this non-limiting embodiment, cavity 56 is an enclosed spaced formed by opening 50 of anvil 22 and by a surface of second arm 20. In this non-limiting embodiment, cavity 56 includes a cylindrical shape. In other non-limiting embodiment, cavity 56 can include a space that is not entirely enclosed, such as in the case of anvil 22 including a non-tubular configuration such as a plurality of posts/columns, a mesh, etc.

As shown in FIG. 5A, push pin 18 is engaged with hole 60 of rivet 54 in such a way as to remove rivet 54 from seal carrier 46 and retaining ring 48. In this non-limiting embodiment, second arm 20 forms an endwall of cavity 56. In other non-limiting embodiments, cavity 56 can extend into a portion of second wall 20 or extend completely through second wall 20 to form a pass-through slot. Anvil 22 is in contact with seal carrier 46. Anvil 22 is mounted and/or attached to second arm 20. The tubular sidewall of anvil 22 and a surface of second arm 20 form the boundaries of cavity 56.

Cavity 56 is configured to capture rivet 54 upon removal of rivet 54 from seal carrier 46 and retaining ring 48. For example, cavity 56 of anvil 22 provides a receptacle large enough for containing rivet 54 once rivet 54 is removed from seal carrier 46 and retaining ring 48, as well as catching any of tail 62 that may break loose from rivet 54 during the removal process. Additionally, anvil 22 is in contact with seal carrier 46 so as to brace rivet extractor 12 against seal carrier 46 and enable push pin 18 to move rivet 54 relative to anvil 22, seal carrier 46, and retaining ring 48.

FIG. 5B is a side view of push pin 18 and anvil 22 engaged with seal carrier 46 and retaining ring 48, with anvil 22 including cavity 56. FIG. 5B shows push pin 18, second arm 20, anvil 22 (with opening 50 and cavity 56), seal carrier 46 and retaining ring 48 (with passage 52), and rivet 54 (with head 56, shaft 58, hole 60, and tail 62) in a second, un-fastened state.

FIG. 5B shows rivet 54 being captured by cavity 56 of anvil 22 as rivet 54 is separated from seal carrier 46. In the transition from FIG. 5A to FIG. 5B, tail 62 is deformed so as to cause rivet 54 to go from a fastened state (shown in FIG. 5A) with seal carrier 46 and retaining ring 48 (as shown in FIG. 5A) to an un-fastened state with seal carrier 46 and retaining ring 48 (as shown in FIG. 5B). As rivet 54 is pushed by push pin 18 out of passage 52, rivet 54 is separated from seal carrier 46 and rivet 54 disengages from push pin 18. Cavity 56 then captures rivet 54 that is separated from seal carrier 46 in cavity 56. Capturing rivet 54 in cavity 56 upon removing rivet 54 from seal carrier 46 and retaining ring 48 prevents rivet 54 (and tail 62) from becoming loose FOD and thereby preventing damage to or failure of bearing assembly 44.

Figure 6C:
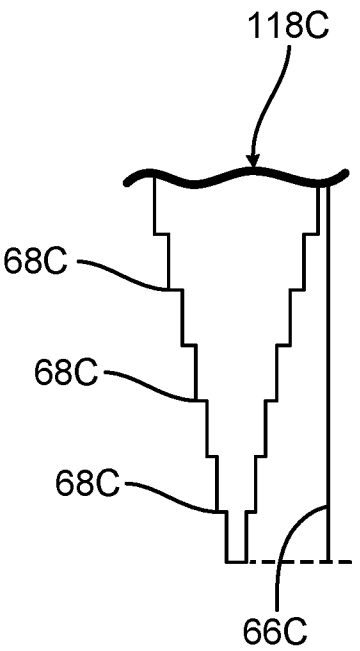
FIGS. 6A-6D show side views of three different push pins useable in the rivet removal tool, respectively including partially tapered, fully tapered, step-tapered, and rounded shapes.
Figure 6B:
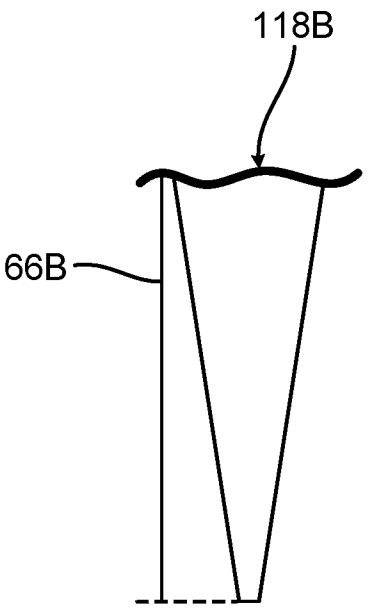
Figure 6A:
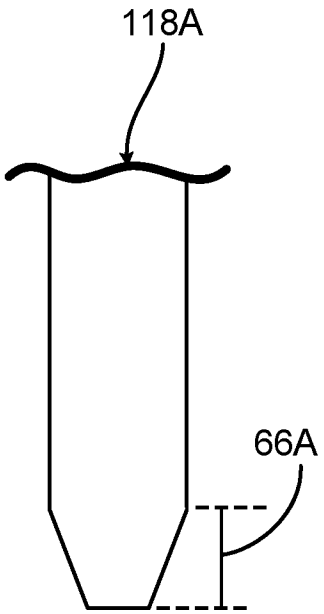
Figure 6D:
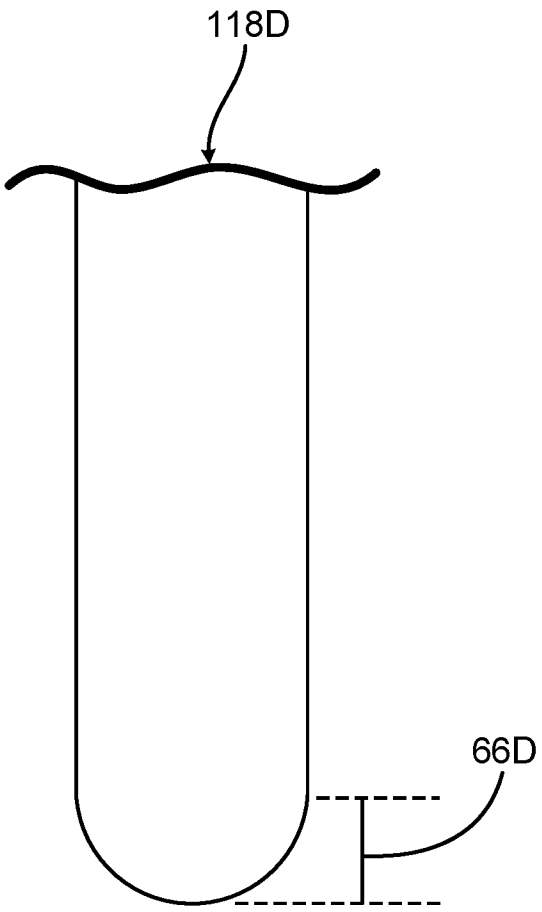

FIGS. 6A-6D respectively show side views of push pins 118A, 118B, 118C, and 118D of rivet removal tool 10. FIG. 6A shows push pin 118A with tapered portion 66A, FIG. 6B shows push pin 118B with tapered portion 66B, FIG. 6C shows push pin 118C with tapered portion 66C including steps 68C, and FIG. 6D shows push pin 118D with tapered portion 66D. Push pins 118A, 118B, 118C, and 118D respectively include a partially tapered, a fully tapered, a step-tapered, and a rounded shape. In other non-limiting embodiment, push pins 18, 118A, 118B, 118C, and/or 118D can include any other tapered configuration.

In FIG. 6A, tapered portion 66A extends along a portion of push pin 118A that is less than half of the length (from top to bottom as shown in FIG. 6A) of push pin 118A. In FIG. 6B, tapered portion 66B is shown to extend an entire length of push pin 118B. In FIG. 6C, tapered portion 66C is shown to extend an entire length of push pin 118C. Tapered portion 66C includes steps 68C which discretely and abruptly increase or decrease an outer diameter of push pin 118C along a length of push pin 118C. In FIG. 6D, tapered portion 66D extends along a portion of push pin 118D that is less than approximately one tenth of the length (from top to bottom as shown in FIG. 6D) of push pin 118D.

Tapered portions 66A, 66B, 66C, and 66D effectively reduce an amount of surface area of push pins 118A, 118B, 118C, and 118D that interacts with rivet 54. This reduction in interaction surface area between push pins 118A, 118B, 118C, and 118D and rivet 54 decreases an amount of adhesion between push pins 118A, 118B, 118C, and 118D and rivet 54. This decreased adhesion between push pins 118A, 118B, 118C, and 118D and rivet 54 allows for rivet 54 to more easily disengage and separate from push pins 118A, 118B, 118C, and 118D during removal of rivet extractor 12 from bearing assembly 44.

In each of the three embodiments shown in FIGS. 6A-6D, push pins 118A, 118B, 118C, and 118D are tapered so as to aid in separating push pins 118A, 118B, 118C, and 118D from rivet 54 upon removal of rivet extractor 12. This reduces the amount of work and time required to effectively remove rivet 54 from bearing assembly 44.

Discussion of Possible Embodiments

The following are non-exclusive descriptions of possible embodiments of the present invention.

A tool for removing a rivet that connects a first article and a second article includes a frame, an anvil, a push pin, and a driver. The frame includes first and second arms. The anvil includes a tube with an opening with an inner diameter and is disposed on the first arm of the frame. The push pin is slidably engaged with the second arm of the frame and is aligned coaxially with the anvil. The push pin is configured to engage with a hole in a tail end of the rivet in order to remove the rivet from the first article. The driver is attached to the frame and is configured to move the push pin in a linear direction towards the anvil in order to push the rivet out of engagement with the first article and such that the first and second articles become unattached.

The assembly of the preceding paragraph can optionally include, additionally and/or alternatively, any one or more of the following features, configurations and/or additional components.

The driver can be configured to convert force applied to the assembly into a force that can be applied to the push pin in order to move the push pin in the linear direction relative to the anvil.

Movement of the push pin relative to the anvil can be configured to be driven by at least one of manual and hydraulic operation.

A lever can be connected to at least one of the anvil and the push pin, wherein the lever can be configured to apply a mechanical advantage in order to cause the anvil to move relative to the push pin.

The lever can comprise first and second handles connected to the driver.

A shape of a portion of the push pin can comprise a taper.

An outer diameter of the push pin can be sized to allow the push pin to enter into the hole of the rivet.

The inner diameter of the opening of the anvil can be sized to allow the head of the rivet to enter into the opening of the anvil.

The anvil can form a cavity configured to capture the rivet upon removal of the rivet from the first article.

A guide can be positioned at an outer end of the first arm, wherein the push pin can extend through and is slidably engaged with the guide, and/or a jaw can be positioned at an outer end of the second arm, wherein the anvil can be mounted to the jaw.

A method of removing a rivet from first and second articles includes aligning a rivet removal assembly with the rivet. The rivet removal assembly includes a push pin and an anvil with a tube and push pin. The push pin includes a head and a hole disposed on an opposite end of the rivet from a head of the rivet. The push pin is configured to move linearly relative to the anvil. Aligning the rivet removal assembly with the rivet includes aligning the push pin with a hole in the rivet. The anvil is brought into contact with the first article. The push pin is moved in a linear direction and towards to the anvil. A tip of the push pin is inserted into the hole of the rivet. The push pin is brought into contact with the rivet. The rivet is pushed with the push pin to separate the rivet from the first article.

The method of the preceding paragraph can optionally include, additionally and/or alternatively, any one or more of the following steps, features, configurations and/or additional components.

The rivet can be disengaged from the push pin.

The separated rivet can be captured in a cavity located in the anvil, wherein the cavity can be disposed in an interior of the tube.

The rivet can comprise a fully tubular rivet, semi-tubular rivet, semi-tubular step rivet, or a special tubular rivet.

Force can be applied to the rivet removal assembly, and the force applied to the rivet removal assembly can be converted into a force that can be applied to the push pin in order to move the push pin in the linear direction relative to the anvil.

Applying force to the rivet removal assembly can comprise applying at least one of a hydraulic force and a manual force to a lever of the rivet removal assembly.

The lever can be configured to apply a mechanical advantage in order to cause relative motion between the anvil and the push pin.

An upset portion of the rivet can be deformed such that the rivet disengages from the first article, and/or further such that the rivet can go from a fastened state with the first article to an un-fastened state with the first article.

The first article can be detached from the second article.

While the invention has been described with reference to an exemplary embodiment(s), it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment(s) disclosed, but that the invention will include all embodiments falling within the scope of the appended claims.

The invention claimed is:

1. A tool for removing a rivet that connects a first article and a second article, the tool comprising:

a frame comprising first and second arms;

an anvil disposed on the first arm of the frame, the anvil comprising a tube with an opening with an inner diameter;

a push pin slidably engaged with the second arm of the frame, wherein the push pin is further configured to engage with a hole in a tail end of the rivet in order to remove the rivet from the first article, wherein the push pin is aligned coaxially with the anvil; and a driver attached to the frame, wherein the driver is configured to move the push pin in a linear direction towards the anvil in order to push the rivet out of engagement with the first article and such that the first and second articles become unattached, wherein the driver comprises a five pivot push pin and clevis assembly.

2. The tool of claim 1, wherein the driver is configured to convert force applied to the tool into a force that is applied to the push pin in order to move the push pin in the linear direction relative to the anvil.

3. The tool of claim 2, wherein movement of the push pin relative to the anvil is configured to be driven by at least one of manual and hydraulic operation.

4. The tool of claim 2, further comprising a lever connected to at least one of the anvil and the push pin, wherein the lever is configured to apply a mechanical advantage in order to cause the anvil to move relative to the push pin.

5. The tool of claim 4, wherein the lever comprises first and second handles connected to the driver.

6. The tool of claim 1, wherein a shape of a portion of the push pin comprises a taper.

7. The tool of claim 1, wherein an outer diameter of the push pin is sized to allow the push pin to enter into the hole of the rivet.

8. The tool of claim 1, wherein the inner diameter of the opening of the anvil is sized to allow the head of the rivet to enter into the opening of the anvil.

9. The tool of claim 1, wherein the anvil forms a cavity configured to capture the rivet upon removal of the rivet from the first article.

10. The tool of claim 1, further comprising:

a guide at an outer end of the first arm, wherein the push pin extends through and is slidably engaged with the guide; and a jaw at an outer end of the second arm, wherein the anvil is mounted to the jaw.

11. A method of removing a rivet from first and second articles, the method comprising:

aligning a rivet removal tool with the rivet, wherein the rivet removal tool comprises:

an anvil comprising a tube;

a push pin configured to move linearly relative to the anvil, and wherein aligning the rivet removal tool with the rivet comprises aligning the push pin with a hole in the rivet, wherein the hole in the rivet is disposed on an opposite end of the rivet from a head of the rivet; and a driver configured to move the push pin in a linear direction towards the anvil, wherein the driver comprises a five pivot push pin and clevis assembly;

bringing the anvil into contact with the first article;

moving the push pin in a linear direction and towards the anvil;

inserting a tip of the push pin into the hole of the rivet;

bringing the push pin into contact with the rivet; and pushing the rivet with the push pin to separate the rivet from the first article.

12. The method of claim 11, further comprising disengaging the rivet from the push pin.

13. The method of claim 12, further comprising capturing the separated rivet in a cavity located in the anvil, wherein the cavity is disposed in an interior of the tube.

14. The method of claim 11, wherein the rivet comprises a fully tubular rivet, semi-tubular rivet, semi-tubular step rivet, or a special tubular rivet.

15. The method of claim 11, further comprising:

applying a first force to the rivet removal tool; and converting the first force applied to the rivet removal tool into a second force that is applied to the push pin in order to move the push pin in the linear direction relative to the anvil.

16. The method of claim 15, wherein applying the first force to the rivet removal tool comprises applying at least one of a hydraulic force and a manual force to a lever of the rivet removal tool.

17. The method of claim 16, wherein the lever is configured to apply a mechanical advantage in order to cause relative motion between the anvil and the push pin.

18. The method of claim 11, further comprising deforming an upset portion of the rivet such that the rivet disengages from the first article, and further such that the rivet goes from a fastened state with the first article to an un-fastened state with the first article.

19. The method of claim 11, wherein separating the rivet from the first article further comprises detaching the first article from the second article.

* * * * *